US005997062A

United States Patent [19]

Schwartz

[11] Patent Number: 5,997,062

[45] Date of Patent: Dec. 7, 1999

[54] GOLF BALL RETRIEVER

[76] Inventor: Nathan Schwartz, 99 County St., Norwalk, Conn. 06851

[21] Appl. No.: 09/208,730

[22] Filed: Dec. 9, 1998

[51] Int. Cl.[6] ..... A63B 47/02

[52] U.S. Cl. ..... 294/19.2

[58] Field of Search ..... 294/19.2, 55, 66.1, 294/99.1; 37/316; 56/328.1, 332, 400.01, 400.04, 400.11; 473/286

[56] References Cited

U.S. PATENT DOCUMENTS

| | | | |
|---|---|---|---|
| 2,738,214 | 3/1956 | Zimmers | 294/19.2 |
| 3,046,044 | 7/1962 | Christle | 294/19.2 |
| 3,115,740 | 12/1963 | Hartley et al. | 294/19.2 X |
| 3,442,544 | 5/1969 | Faber | 294/19.2 |
| 3,627,317 | 12/1971 | Whitsitt | 294/19.2 X |
| 4,322,939 | 4/1982 | McDonald | 294/19.2 X |
| 4,974,894 | 12/1990 | Dubow | 294/19.2 |
| 5,246,260 | 9/1993 | Racicot | 294/19.2 |
| 5,572,519 | 11/1996 | Mansbridge | 294/19.2 |
| 5,590,924 | 1/1997 | Quinn et al. | 294/19.2 |

*Primary Examiner*—Johnny D. Cherry

[57] ABSTRACT

A golf ball retriever which is attached to an elongated holder for retrieving golf balls from water hazards. It consists of a combination of two sections. The first section straddles and confines the ball laterally, and the second section is a trailing cage having a pair of hooks used to entrap the ball when the hooks are pulled under the ball, and which, when inverted, becomes a ball-carrying basket.

3 Claims, 2 Drawing Sheets

GOLF BALL RETRIEVER

BACKGROUND OF THE INVENTION

1. Technical Field

This invention related to golf ball retrievers which can be carried in a golfer's golf bag for use in retrieving balls from water hazards.

2. Description of Prior Art

The many types of golf ball retrievers that have been proposed in the past have disadvantages. The retrieving features of conventional compact design retrievers are usually scoops or rings or some combination of the two. These require too accurate a placement above or under or at the side of a golf ball which is usually in mud or debris. Golfers very often find that such retrievers are not easy or effective to use. Too frequently they press the ball deeper into the mud and sediment causing failure to retrieve it. Other retrievers that are in the form of rakes are too bulky and cumbersome to carry. Many proposed retrievers are also very costly to manufacture.

The present invention overcomes the above-mentioned problems.

The following patents of golf ball retrievers were referenced to determine the advantages of the present invention:
U.S. Pat. No. 3,046,044 July 1962 Christe 294/19.2
U.S. Pat. No. 3,773,374 November 1973 D'Luhy 294/19.2
U.S. Pat. No. 4,046,413 September 1977 Jenings 294/19.2
U.S. Pat. No. 4,254,981 March 1981 Wilson 294/19.2

BRIEF SUMMARY OF THE INVENTION

An important object of the present invention is to provide an improved device for retrieving golf balls from water hazards and to overcome the disadvantages of conventional retrievers.

More specifically, several other objects and advantages of the present invention are:

(a) to provide a golf ball retriever that is of compact and simple design and therefore economical to manufacture;

(b) to provide a golf ball retriever that can retrieve a ball quickly and without fumbling and therefore be easier to use than prior retrievers;

(c) to provide a golf ball retriever that is more effective than conventional retrievers of compact design when used to retrieve a ball that is partly buried in mud or debris by dropping a hook behind the ball and, while confining the ball laterally, by pulling the ball from the rear instead of pressing down on the ball or scooping from the sides or pushing under the ball;

(d) to provide a golf ball retriever that does not require the precision of conventional compact retrievers in the placement of the retrieving feature at the ball location.

It is also an advantage of this invention that the golf ball retriever designed to accomplish the above-specified objects can snap over a ball to entrap it when the ball is at close range and on a firm surface.

The objects and advantages of the present invention will become apparent from a consideration of the ensuing description and drawings.

DETAILED DESCRIPTION OF THE INVENTION

Figure 4:
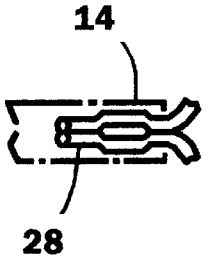
FIG. 4 is a fragmentary view of an alternate construction of the retriever extension.
Figure 5:
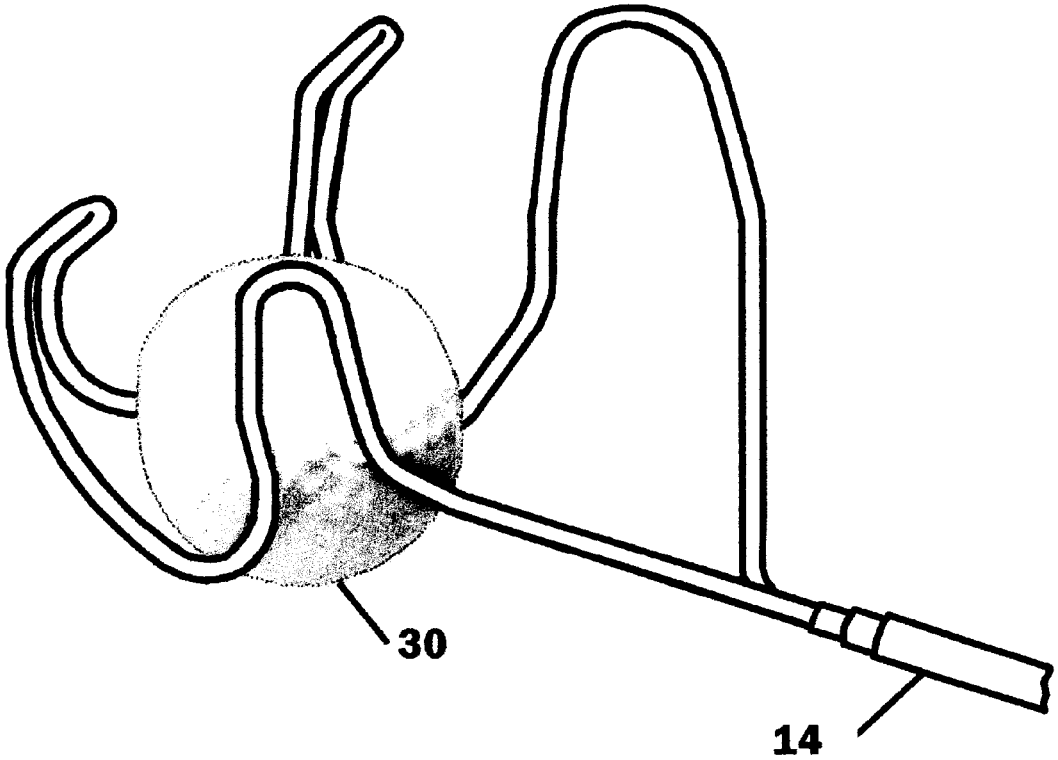
FIG. 5 is a three-dimensional view of the golf ball retriever of the present invention showing the retriever inverted.

The golf ball retriever of the present invention comprises of a combination of two separate but interconnected and sequentially operated compartments for retrieving a golf ball in a water hazard. The wireform shown in FIGS. 1, 2, and 3 has extensions 10 that are attached by crimping or staking to an extendable length holder, shown in all figures as item 14. The holder is shown schematically in FIGS. 1, 2, 3, and 4. The holder normally consists of telescoped tubing as indicated in FIG. 5. The tubes are normally of variable overall length. Such tubes normally have provision to tighten tube to tube to prevent tube rotation relative to the gripping end, before retrieving a golf ball. The end of the holder gripped by the golfer is normally covered by a rubber or plastic grip, which is not shown. The ends of extensions 10 are deformed by partial shearing to create lugs 12, as seen in top view FIG. 2, to assure retention of extension 10 in the holder. As an alternative, the ends of the extensions, shown as a variation and as item 28 in FIG. 4, may be deformed by bending to assure retention in the holder. For convenience in manufacturing, an intermediate adapter, not shown, may be used between the above-mentioned extension and the end of the holder. Such an adapter and other methods of deforming extension ends 10 may be used without departing from the scope of this invention.

The initial action in using the retriever is to confine the golf ball laterally. This is accomplished in the first or advance compartment. This first advance compartment is totally devoid of overhead components or elements so as to avoid pressing down on and burying a ball during retrieval. This advance compartment includes segments 16, shown in FIGS. 1, 2, and 3, which provide the lateral confining action by straddling the ball. In the initial action, the opening between segments 16 is placed and dropped over the ball, which is shown as item 30 in FIG. 1 and FIG. 5. The space between segments 16 is tapered to create a ball entry space which is substantially wider than the trailing compartment, which is described below as an entrapment cage. This wide space obviates the need to be precise when placing the retriever at the ball location. The point of widest space between segments 16 is also low for providing the ball straddling and confining capability. The bends in each segment 16 may vary from being sharp to being a single, continuous curve until the bend at extension 10.

Figure 1:
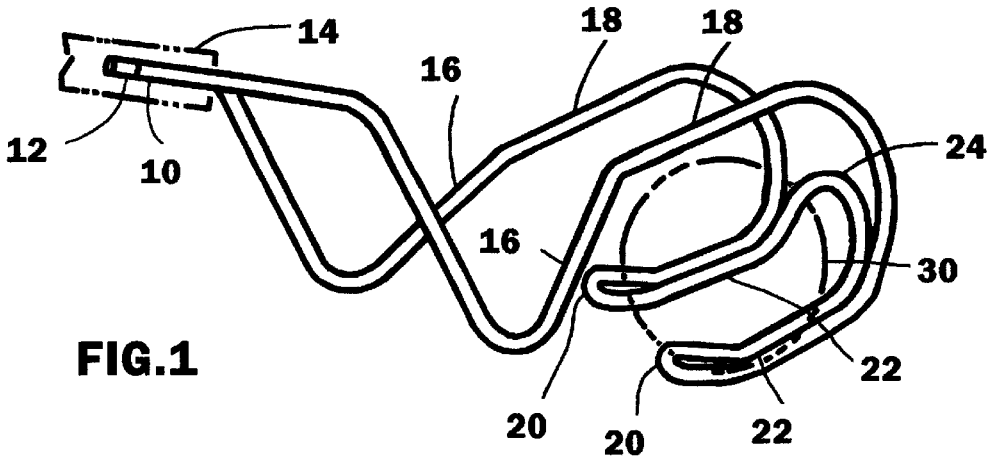
FIG. 1 is a perspective view of the golf ball retriever of the present invention.
Figure 2:
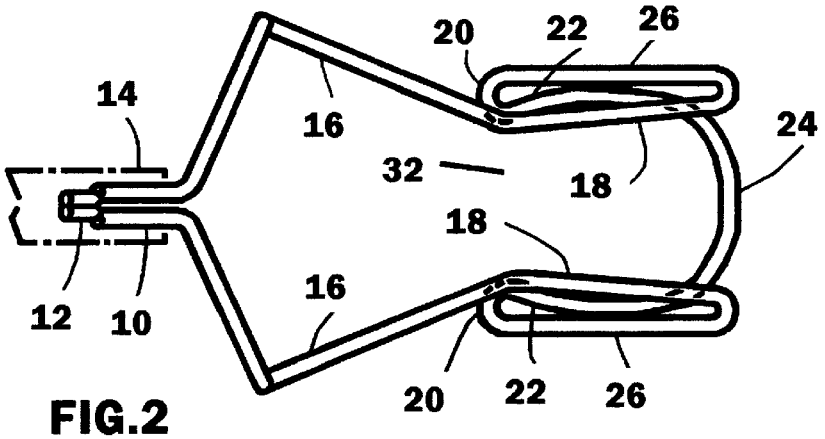
FIG. 2 is a top view of the golf ball retriever of the present invention.
Figure 3:
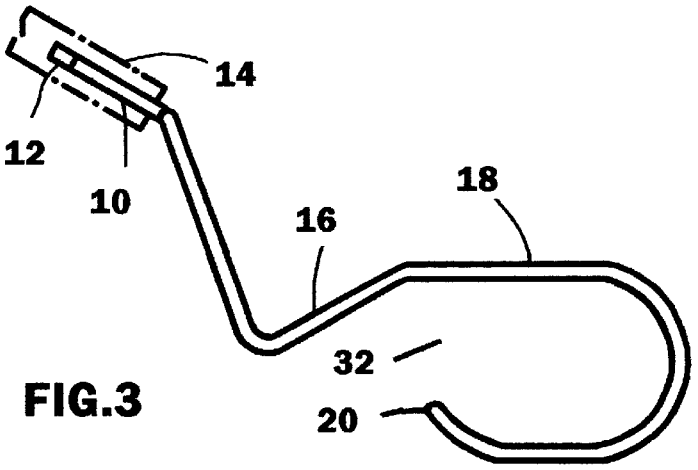
FIG. 3 is a side view of the golf ball retriever of the present invention.

After the ball is confined laterally, the second retrieving action is to pull the ball into the connected trailing compartment, which is an entrapment cage, through cage entrance 32. When the retriever is pulled, converging segments 16 guide the ball to the cage entrance. FIG. 1 shows the cage which has an upper pair of downward curved segments 18, a lower pair of hooks as segments 22, and a central backup element as segment 24, which connects segments 22. Each segment 22 is folded back on itself laterally to form outside, generally parallel, segments 26, which make the hooks more rigid. The leading part of each segment 22 is curved or bent upward so that the hooks are more effective at maximum extension of the holder and so that the ball is well retained in the cage. Segments 22 form a ball seat shaped as a circular rim around a space only slightly smaller than the diameter of a golf ball. The leading ends 20 of the hooks are round as shown in FIGS. 1 and 2, and can therefore smooth the movement across the bottom of the water hazard. The vertical space between segments 22 and segments 8 is less than the diameter of a golf ball, but is large enough to allow vertical movement of a golf ball within the cage to facilitate entry of the ball into the cage. The lateral space between segments 18 is smaller than the diameter of a golfball and may be tapered as shown, or segments 18 may be parallel.

While pulling the entrapped ball, the gripped end of the holder is raised to assure retention in the cage. Optionally, the holder is rotated on its axis one-half turn so as to invert the cage. The inverted cage is a basket, illustrated in FIG. 5, which provides an easier and more secure way to transfer the ball from water to land.

As one of the advantages of this invention, retrieving action is also possible when a golf ball is at close range and on a firm surface, by using segments 18 to snap over the ball to entrap it.

Material used for the wireform can be painted or plastic-coated, low carbon steel wire of number 12 gage size which provides adequate rigidity. Stainless steel or tempered aluminum wire of equivalent size and strength are also suitable. Many other materials or combinations of materials or varying thicknesses can be used without departing from the scope of this invention.

I claim:

1. A golf ball retriever comprising a combination of an advance and a trailing compartment, said compartments being separate but interconnected and sequentially operated, said combination of compartments attached to an extendable length holder, said advance compartment comprising straddling elements to laterally confine a ball, said advance compartment having an opening between the straddling elements, said opening being totally clear of overhead elements, whereby said opening prevents pressing down on and burying a ball being retrieved, and said trailing compartment comprising a pair of upper and a pair of lower elements and a central backup element, said elements being so disposed as to be a ball-entrapment cage, and said lower elements being a ball seat having a pair of hooks at the cage entrance, said hooks having substantially rounded leading ends, whereby the movement of said retriever across the bottom of a water hazard is smoothed, said ball seat having the shape of a circular rim around a space slightly smaller than the diameter of a golf ball, and said cage becoming a basket when said holder is rotated about its axis one-half turn to invert said cage, whereby said basket can more securely retain a ball being transferred out of water.

2. The retriever of claim 1 wherein the width of said opening in said advance compartment is substantially greater than the width of said cage, whereby substantial leeway is provided in spotting the location of a ball.

3. The retriever of claim 2 wherein said straddling elements in the advance compartment converge toward said cage to function as ball-guiding elements.

* * * * *